United States Patent [19]

Federico et al.

[11] Patent Number: 4,997,391

[45] Date of Patent: Mar. 5, 1991

[54] TRIAXIAL CONNECTOR ADAPTER

[75] Inventors: Panfilo A. Federico, Kennedy Township, Alleheny County; Louis W. Gaussa, Jr., Penn Township, Westmoreland County, both of Pa.

[73] Assignee: Westinghouse Electric Corp., Pittsburgh, Pa.

[21] Appl. No.: 522,766

[22] Filed: May 14, 1990

[51] Int. Cl.[5] ..... H01R 13/66

[52] U.S. Cl. ..... 439/580; 439/628

[58] Field of Search ..... 439/578–585, 439/628

[56] References Cited

U.S. PATENT DOCUMENTS

| | | | |
|---|---|---|---|
| 4,267,536 | 5/1981 | Hollyday | 439/628 |
| 4,674,809 | 6/1987 | Hollyday | 439/580 |
| 4,857,014 | 8/1989 | Alf et al. | 439/628 |

*Primary Examiner*—Joseph H. McGlynn
*Attorney, Agent, or Firm*—M. G. Panian

[57] ABSTRACT

Triaxial connector adapters for connecting triaxial cables. Triaxial connector adapters provided in accordance with the present invention allow connection of triaxial cables having different bend radii, thereby ensuring that monitoring instruments in, for example, the nuclear power industry, can be sealed in accordance with federal regulations. Furthermore, triaxial connector adapters disclosed herein provide quick, efficient and safe retrofitting of existing monitoring instruments which use standard large bend radius triaxial cables. The triaxial connector adapters comprises triaxial housings for providing an outer shield conductor for the triaxial connector adapter and interfacing to a first triaxial cable, inner shields interfaced with the triaxial housings for providing an inner conductor for the triaxial connector adapter and carrying electric current through the triaxial connector adapter, center conductors interfaced with the inner shields for carrying electric current through the triaxial connector adapter, and connectors interfaced with the triaxial housings for connecting a second triaxial cable to the triaxial connector adapters and electrically interfacing the first triaxial cable with the second triaxial cable.

21 Claims, 2 Drawing Sheets

TRIAXIAL CONNECTOR ADAPTER

FIELD OF THE INVENTION

This invention relates generally to triaxial cables which carry signals from detectors to monitoring equipment. More specifically, this invention relates to triaxial connector adapters for interfacing triaxial cables together while maintaining signal integrity and minimizing signal interference.

BACKGROUND OF THE INVENTION

Triaxial cables have been used for carrying electrical signals between detectors and monitoring instruments for some time. Many industries utilize triaxial cables for carrying signals from detectors to monitoring instruments. The nuclear power industry particularly uses triaxial cables to transmit various types of signals from detectors placed in and around a nuclear reactor to instruments which may be located some distance away from the detectors.

Generally, triaxial cables are comprised of three sheathed conductors. A center conductor carries electric current to the monitoring instrument corresponding to an electrical signal from a detector. A second conductor, generally denoted as an "inner shield," functions as return conductor for the electric current in the center conductor. An outer conductor functions as an outer conducting shield and prevents stray electromagnetic signals from impinging on the two inner conductors of the triaxial cable. Insulating layers are usually placed between the three conductors in the triaxial cable to electrically separate the conductors from one another.

Triaxial cables utilized in the nuclear power industry between detectors and monitoring units can carry voltages of up to about 2500 volts DC or small current signals in a range of about 10 picoamps to about 1 milliamp. Additionally, small pulse signals from neutron counters in a range from about 1 millivolt to about 10 millivolts may be carried on triaxial cables used in nuclear power monitoring equipment.

There are many types of triaxial cables which may be utilized to carry signals from detectors to monitoring equipment. Examples of such cables are the RG-11 triaxial cable, the RG-58 triaxial cable, and the RG-59 triaxial cable. The most common triaxial cable used in the nuclear power industry is the RG-11 triaxial cable which ensures minimal attenuation of detector signals and minimum interference of detector signals as they are transmitted over the cable to the monitoring instrument.

Termination of the RG-11 cable is usually within an instrument cabinet where the cable is connected to the instrument through a male or female RG-11/u connector. The physical construction of an RG-11 triaxial cable precludes bending it in any arc with a bend radius of less than 6 inches. If less than a 6-inch bend radius is encountered, the center conductor of the RG-11 cable may migrate through the insulation and voltage arcing between the inner conductors may occur, or shorts may develop with a concomitant loss of signal as a result. However, there is usually an insufficient area to maintain more than a 6-inch bend radius between the rear cabinet door and the instrument and therefore for instruments which use RG-11 cables, the rear cabinet doors are usually left open to prevent the RG-11 cable from being forced into a bend radius of less than 6 inches.

Today, the Nuclear Regulatory Commission enforces closing of the instrument cabinet doors to ensure safety. Thus, there is a need in the art for a practical solution for using existing RG-11 triaxial cables with nuclear monitoring instrumentation having RG-11 instrument bulkhead connectors while complying with federal regulations. Replacement of the RG-11 triaxial cables and associated instrument bulkhead connectors is not practical since the associated downtime, costs, testing and calibration times are all too high. A possible solution is to interpose a smaller, more flexible triaxial cable having a smaller bend radius between the termination end of the RG-11 cable and the connector on the instrument while maintaining signal integrity through a splice of the two cables and associated connectors.

Potential triaxial cables are the RG-58 and RG-59 triaxial cables, both which have a bend radius of about 2–3 inches. However, heretofore no existing connector adapter has been produced or designed for connecting different sized triaxial cables together. Furthermore, it is not practical to change from triaxial cables to coaxial cables using a coaxial connector adapter since loss of the outer shield found in a triaxial cable when a coaxial cable is used creates a substantial opportunity for introducing signal interference and noise during monitoring of a particular process in a nuclear power plant.

There is therefore a long-felt need in the art for a triaxial connector adapter which interfaces RG-11 to RG-58, RG-11 to RG-59, and RG-11 to RG-11 triaxial cables while maintaining total signal integrity and isolation through the connector adapter. Furthermore, triaxial connector adapters should permit changing the mating interface of BNC, TNC or RG-59 triaxial connectors.

SUMMARY OF THE INVENTION

The above-mentioned long-felt needs in the art are solved by triaxial connector adapters provided in accordance with the present invention. Triaxial connector adapters provided in accordance with this invention allow interfacing of smaller bend radius triaxial cables to standard RG-11 triaxial cables having a larger bend radius. Furthermore, triaxial connector adapters provided in accordance with the present invention eliminate downtime, excessive costs, testing and calibration since RG-11 cables and bulkhead connectors will not have to be replaced in present nuclear monitoring instrumentation.

In accordance with the present invention, triaxial connector adapters for connecting triaxial cables comprising triaxial housing means for providing an outer shield conductor for the triaxial connector adapter and interfacing with a first triaxial cable, inner shield means interfaced with the first triaxial housing means for providing an inner conductor for the triaxial connector adapter and carrying electric current to the triaxial connector adapter, center conducting means interfaced with the inner shield means for carrying electric current to the triaxial connector adapter, and bulkhead connecting means interfaced with the triaxial housing means for connecting the second triaxial cable to the triaxial connector adapter and electrically interfacing the first triaxial cable with the second triaxial cable are provided.

Additionally, methods of connecting monitoring instruments to detectors are provided in accordance with the present invention. The methods comprise the steps of providing a connector to connect a first triaxial cable to the monitoring instrument, adapting the connector with a first triaxial adapter to connect the second triaxial cable to the monitoring instrument, connecting the second triaxial cable to the first triaxial adapter, connecting a second triaxial adapter to the second triaxial cable, connecting the first triaxial cable to the second triaxial connector, and connecting the detector to the first triaxial cable.

DETAILED DESCRIPTION OF PREFERRED EMBODIMENTS

Figure 1:
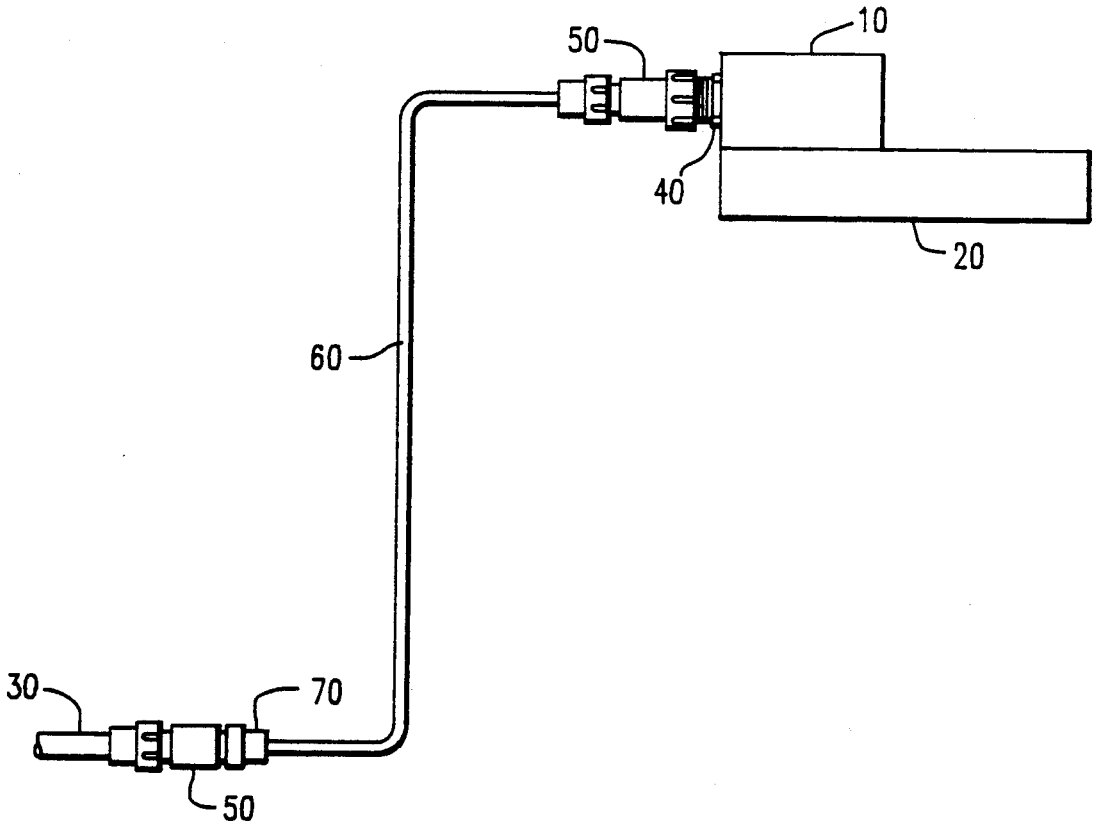
FIG. 1 illustrates a monitoring instrument having triaxial connector adapters in accordance with the present invention for connecting an RG-58 or RG-59 triaxial cable to an existing RG-11 field triaxial cable.

Referring now to the drawings wherein like reference numerals refer to like elements, FIG. 1 shows a monitoring instrument preferably for use in the nuclear power industry at 10. In preferred embodiments, the instrument comprises a chassis 20 for grounding monitoring electronics associated with the instrument. In further preferred embodiments, the instrument electronics may be adapted to analyze current signals from ionization chambers, neutron counters, or other detectors which are generally useful for monitoring nuclear power plant processes. In still further preferred embodiments, signal currents are carried to instrument 10 from sensors located some distance away from the instruments by a triaxial cable shown generally at 30.

Instrument 10 is adapted to connect to triaxial cable 30 at a bulkhead connector shown at 40. In still further preferred embodiments, connector 40 is interfaced with instrument 10 and designed to accept a first triaxial cable having a specified size. An example of such a cable is a triaxial RG-11 cable typically used in the nuclear power industry to carry cable voltages of approximately 2500 volts DC, small current signals from the 10 picoamp to 1 milliamp range, or small pulse signals from nuclear detectors in the 1–10 millivolt range.

As described above, RG-11 triaxial cables are used in the nuclear power industry to transmit various types of signals from detectors placed in and around a reactor to instruments some distance away from the reactor. The physical construction of RG-11 triaxial cables precludes flexing them in any arc having a bend radius of less than 6 inches since the center conductor in the cable may migrate through the cable's internal insulation when the RG-11 triaxial cable is bent with a radius of less than 6 inches. Center conductor migration through the insulation causes high voltage arcing or shorting of the center conductor to the RG-11 cable's inner shield, thereby causing loss of signal and inaccurate analysis of the nuclear detector output.

Generally, instrument 10 is housed within an instrument cabinet and there is an insufficient area to maintain a 6-inch bend radius between the rear cabinet door and the instrument if the door is closed. Heretofore in order to accommodate an RG-11 cable as it mates with bulkhead connector 40 and instrument 10 in the cabinet, the cabinet's doors have been left open to prevent the cable from being formed into too small an arc with the aforementioned resultant problems.

However with enforcement of regulations requiring instrument cabinet doors to be closed in the nuclear power industry, the triaxial cables must be adapted to be housed within the instrument cabinet with the door closed. Smaller triaxial cables, for example RG-58 or RG-59 triaxial cables, can be flexed with a bend radius of less than 6 inches, and thus can be housed within the instrument cabinet with the door closed. However, instruments for monitoring nuclear reactions in a nuclear power plant are usually adapted to connect to RG-11 cables through a male or female RG-11/u connector and this is an industry standard.

Therefore, it is desirable to construct a triaxial connector adapter to interface bulkhead connector 40 to an RG-58 or RG-59 triaxial cable which can fit within an instrument cabinet, or a similar triaxial connector adapter which will interface an RG-58 or RG-59 triaxial cable to a larger bend radius RG-11 cable which carries signals from remote detectors in a nuclear power plant to the instrument. Such a connector is shown generally at 50 in FIG. 1.

In preferred embodiments, connector 50 allows the smaller, more flexible triaxial cable 60 to be interfaced with instrument 10 through bulkhead connector 40. In further preferred embodiments, triaxial cable 60 is an RG-58 or RG-59 flexible triaxial cable with a smaller bend radius than the existing RG-11 field cable 30. Generally, RG-58 and RG-59 triaxial cables have bend radii of about 2–3 inches. Thus, interfacing an RG-58/59 triaxial cable to triaxial connector adapter 50 through the RG-11 bulkhead connector 40 on instrument 10 allows the cable 60 to be fitted into the instrument cabinet so that the door can be closed in compliance with federal nuclear power plant regulations.

The RG-11 field cable 30 is interfaced to second triaxial connector adapter 50 provided in accordance with the present invention. Second triaxial connector adapter 50 is then preferably interfaced with RG-58 or RG-59 cable 60 through an RG-58/59 triaxial connector shown generally at 70. This allows the RG-11 30 cable to be interfaced to the RG-58 or RG-59 triaxial cable 60 and ultimately to instrument 10 while maintaining the advantages of transmitting signals over a triaxial cable; namely, retaining the outer shield in the triaxial cable, thereby limiting interference with the signal from noise. Such advantages are not achievable with a coaxial cable since coaxial cables do not have an outer shield to prevent signal interference.

Figure 2:
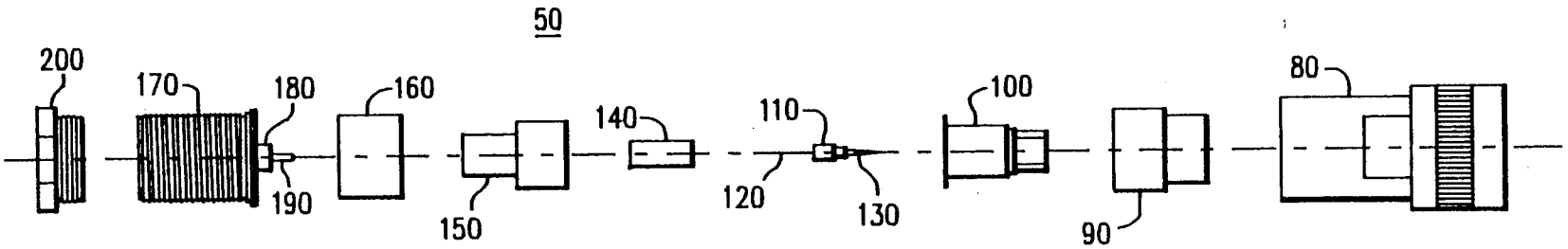
FIG. 2 is an exploded view of a triaxial connector adapter provided in accordance with the present invention.

Referring now to FIG. 2, an exploded view of triaxial connect adapter 50 is shown. In preferred embodiments, triaxial connector 50 is designed to emulate an RG-11 male connector. However, it will be recognized by those with skill in the art that an RG-11-like female triaxial connector adapter may also be provided in accordance with the present invention.

Triaxial housing means 80 are provided to the triaxial connector adapter for providing an outer conductor. In preferred embodiments, the smaller first triaxial cable, preferably an RG-58/59 triaxial cable, will be interfaced with the triaxial housing 80. A front insulating means 90 is interfaced in the housing means 80 to ensure that an inner body contact means is insulated from shorting against the triaxial housing means 80.

A center conducting means 110 is interfaced with the inner body contact means 100 and carries an electric signal or current between the triaxial connector adapter from the RG-11 cable to the RG-58/59 cable. In still further preferred embodiments, center conductor means 110 comprises a pin 130 and solid center conductor 120. Center insulating means 140 is interfaced and fitted over center conducting means 120 and insulates the center conducting means from the inner body contact means 100 to prevent arcing between the inner body contact means and center conducting means and to prevent signal interference. Center insulator means 140 and center conducting means 110 may be inserted through inner body contact means 100 so that the center pin 130 matches the physical specification of an actual RG-11 center conductor pin, as well as the center conductor pin's actual position in an RG-11 cable.

In still further preferred embodiments of triaxial connector adapters provided in accordance with the present invention, inner shield means 150 is interfaced and slides over the center insulator 140 and center conductor combination to mate with the end of the inner body contact means 100. The inner shield means 150 interfaces as described above and provides an inner conductor for the triaxial connector adapter to provide a second conducting path within the triaxial connector corresponding to the second conducting path in both the RG-11 and RG-58/59 cables. In still further preferred embodiments, inner shield means 150 comprises a copper block which provides good electrical conductivity of current through the triaxial connector adapter. Furthermore, inner body contact conductor 100 provides a means for matching center conductor 110 with a center conductor in the corresponding mating cable.

Rear insulating means 160 is then fitted over the end of the inner shield copper block 150 to insulate the inner shield copper block and prevent it from shorting against the outer shield, i.e., the triaxial housing means 80. In preferred embodiments, connecting means 170 is interfaced with the triaxial housing means 80 and electrically interfaces the RG-11 triaxial cable to the RG-58/59 triaxial cable. Connecting means 170 provides a modified bulkhead for the triaxial connector adapter and preferably comprises an inner shield conductor 180 and a solid center conductor 190. Connecting means 170 is positioned so that inner shield copper block 150 aligns with and mates to inner shield conductor 180, and solid center conducting means 110 aligns with and mates to center conductor 190.

Plug nut means 200 is provided to the triaxial connector adapter and interfaces with the connecting modified bulkhead means 170 for securing front insulator means 90 to triaxial housing means 80. Plug nut 200 is screwed into the threaded end of RG-11 plug 80 and has an inner hole so it will fit over the end of the modified bulkhead connector 170. Preferably, the hole in plug nut 200 has either a machined edge for a compression fit or is threaded, in which case it first screws over the modified bulkhead connector 170 before the plug nut 200's outer threads engage the threads which are cut into a bottom, inner portion of the RG-11 plug barrel 80. After plug nut 200 is securedly interfaced with the RG-11 plug 80 the assembly is completed.

Triaxial connector adapters provided in accordance with the present invention ensure that outer shield conductor integrity is maintained throughout the RG-11 connector outer assembly. Outer shield conductor integrity is passed by an RG-11 plug 80 endcap to the bulkhead connector 40 outer assembly and out to the outer shield conductor of the RG-58/59 triaxial cable so that signal interference and loss is minimized. The inner shield 150 and center conductor 110 are also isolated by rear insulator 160 and center insulator 140 respectively. Thus, complete signal integrity is provided with triaxial connector adapters in accordance with the present invention.

Triaxial connector adapter provided in accordance thus give flexible interconnection abilities with different sized triaxial connectors and also maintain total signal integrity and isolation through the connector and the various sized triaxial cables. Any smaller cable may be attached simply by screwing it onto the triaxial connector adapter through its own triaxial connector. Triaxial connector adapters provided in accordance with the present invention are easily adaptable to present monitoring instruments in the nuclear power industry with a minimum of downtime for the instruments, and many cables can be simply adapted without shutting down the particular monitoring instrument.

Furthermore, since signal integrity and isolation are maintained with triaxial connector adapters provided in accordance with the present invention, testing and calibration of the monitoring instruments need not be repeated on a stepped-up basis when present functioning monitoring instruments are retrofitted with triaxial connector adapters. Retrofitting of present monitoring instruments with triaxial connector adapters provided in accordance with the present invention can be accomplished at the instrument cabinet. Furthermore, since the triaxial connector adapters are easily applied to present day instruments, the costs associated with retrofitting are minimized. Triaxial connector adapters provided in accordance with the present invention solve a long-felt need in the art for devices which economically, efficiently, and safely interface triaxial cables to monitoring instruments. These long-felt needs have not heretofore been satisfied by present triaxial cables and monitoring equipment.

There have thus been described certain preferred embodiments of triaxial connector adapters provided in accordance with the present invention. While preferred embodiments have been described and disclosed, it will be recognized by those with skill in the art that modifications are within the true spirit and scope of the invention. The appended claims are intended to cover all such modifications.

We claim:

1. A triaxial connector adapter for connecting triaxial cables comprising:

triaxial housing means for providing an outer shield conductor for the triaxial connector adapter and interfacing to a first triaxial cable;

inner shield means interfaced with the triaxial housing means for providing an inner conductor for the triaxial connector adapter and carrying electric current through the triaxial connector adapter;

center conducting means interfaced with the inner shield means for carrying electric current through the triaxial connector adapter; and bulkhead connecting means interfaced with the triaxial housing means for connecting a second triaxial cable to the triaxial connector adapter and electrically interfacing the first triaxial cable with the second triaxial cable.

2. The triaxial connector adapter recited in claim 1 further comprising:

inner body contact means interface with the triaxial housing means for matching the center conducting means with a center conductor position in the first triaxial cable.

3. The triaxial connector adapter recited in claim 2 further comprising:

front insulator means interfaced with the inner body contact means for aligning the inner body contact means in a mating position with an inner shield in the first triaxial cable and insulating the inner body contact means and inner shield means from the triaxial housing means.

4. The triaxial connector adapter recited in claim 3 further comprising:

center insulator means interfaced with the center conducting means for insulating the center conducting means from the inner shield means.

5. The triaxial connector adapter recited in claim 4 further comprising:

rear insulator means interfaced with the inner shield means to insulate the inner shield means from the triaxial housing means.

6. The triaxial connector adapter recited in claim 5 further comprising:

plug nut means interfaced with the bulkhead connecting means for securing the front insulator means to the triaxial housing means.

7. An instrument for monitoring processes in a nuclear power plant comprising:

an instrument chassis housed within an instrument cabinet for grounding instrument electronics;

first connecting means interfaced witn the instrument chassis for connecting a first triaxial cable to the instrument; and adapter means interfaced with the connecting means for connecting a second triaxial cable to the connecting means.

8. The instrument recited in claim 7 further comprising second connecting means interfaced with the second triaxial cable for connecting the first triaxial cable to the second triaxial cable.

9. The instrument recited in claim 7 wherein the adapter means comprises:

triaxial housing means for providing an outer shield conductor for the adapter means and interfacing to the first triaxial cable;

inner shield means interfaced with the triaxial housing means for providing an inner conductor for the adapter means and carrying electric current through the adapter means;

center conducting means interfaced with the inner shield means for carrying electric current through the adapter means; and bulkhead interface means in cooperative relationship with the inner shield means for connecting the second triaxial cable to the adapter means and electrically interfacing the first triaxial cable with the second triaxial cable.

10. The instrument recited in claim 9 wherein the adapter means further comprises:

inner body contact means interfaced with the triaxial housing means for matching the center conducting means with a center conductor position in the first triaxial cable.

11. The instrument recited in claim 10 wherein the adapter means further comprises:

front insulator means interfaced with the inner body contact means for aligning the inner body contact means in a mating position with an inner shield in the first triaxial cable and insulating the inner body contact means and inner shield means.

12. The instrument recited in claim 11 wherein the adapter means further comprises:

center insulator means interfaced with the center conducting means for insulating the center conducting means from the inner shield means.

13. The instrument recited in claim 12 wherein the adapter means further comprises:

rear insulator means interfaced with the inner shield means to insulate the inner shield means from the triaxial housing means.

14. The instrument recited in claim 13 wherein the adapter means further comprises:

plug nut means interfaced with the bulkhead interface means for securing the front insulator means to the triaxial housing means.

15. A method of connecting a monitoring instrument to a detector comprising the steps of:

providing a connector to connect a first triaxial cable to the monitoring instrument;

adapting the connector with a first triaxial adapter to connect a second triaxial cable to the monitoring instrument;

connecting the second triaxial cable to the first triaxial adapter;

connecting a second triaxial adapter to the second triaxial cable;

connecting the first triaxial cable to the second triaxial connector; and connecting the detector to the first triaxial cable.

16. The method recited in claim 15 wherein the first triaxial adapter comprises:

triaxial housing means for providing an outer shield conductor for the triaxial connector adapter and interfacing to a first triaxial cable;

inner shield means interfaced with the triaxial housing means for providing an inner conductor for the triaxial connector adapter and carrying electric current through the triaxial connector adapter;

center conducting means interfaced with the inner shield means for carrying electric current through the triaxial connector adapter; and bulkhead connecting means interfaced with the triaxial housing means for connecting a second triaxial cable to the triaxial connector adapter and electrically interfacing the first triaxial cable with the second triaxial cable.

17. The method recited in claim 16 wherein the first triaxial adapter further comprises:

inner body contact means interfaced with the triaxial housing means for matching the center conducting means with a center conductor position in the first triaxial cable.

18. The method recited in claim 17 wherein the first triaxial adapter further comprises:

front insulator means interfaced with the inner body contact means for aligning the inner body contact means in a mating position with an inner shield in the first triaxial cable and insulating the inner body contact means and inner shield means from the triaxial housing means.

19. The method recited in claim 18 wherein the first triaxial adapter further comprises:

center insulator means interfaced with the center conducting means for insulating the center conducting means from the inner shield means.

20. The method recited in claim 19 wherein the first triaxial adapter further comprises:

rear insulator means interfaced with the inner shield means to insulate the inner shield means from the triaxial housing means.

21. The method recited in claim 20 wherein the first triaxial adapter further comprises: plug nut means interfaced with the connecting means for securing the front insulator means to the triaxial housing means.

* * * * *